United States Patent [19]

Janssen

[11] 4,117,391

[45] Sep. 26, 1978

[54] CURRENT STABILIZING CIRCUIT

[75] Inventor: Daniël Johannes Gerardus Janssen, Eindhoven, Netherlands

[73] Assignee: U.S. Philips Corporation, New York, N.Y.

[21] Appl. No.: 776,866

[22] Filed: Mar. 10, 1977

[30] Foreign Application Priority Data

Mar. 31, 1976 [NL] Netherlands ..... 7603321

[51] Int. Cl.[2] ..... G05F 1/56

[52] U.S. Cl. ..... 323/4; 330/257

[58] Field of Search ..... 307/230, 297; 323/1, 323/4, 19; 330/257

[56] References Cited

U.S. PATENT DOCUMENTS

| | | | |
|---|---|---|---|
| 3,851,241 | 11/1974 | Wheatley | 323/19 X |
| 3,906,332 | 9/1975 | Keller | 323/4 |
| 3,934,191 | 1/1976 | Garskamp | 323/1 X |
| 4,019,121 | 4/1977 | Feindt | 323/4 |

FOREIGN PATENT DOCUMENTS

| | | | |
|---|---|---|---|
| 1,266,886 | 3/1972 | United Kingdom | 323/4 |

*Primary Examiner*—A. D. Pellinen

*Attorney, Agent, or Firm*—Frank R. Trifari; Jack E. Haken

[57] ABSTRACT

A current stabilizing circuit comprises a difference amplifier having a defined offset voltage which provides a current which is independent of the operating voltage applied across the circuit. The offset voltage is obtained by using an emitter-coupled pair of transistors with mutually differently current densities as the input stage of the difference amplifier.

10 Claims, 3 Drawing Figures

CURRENT STABILIZING CIRCUIT

The invention relates to a current stabilizing circuit comprising a first and a second connection terminal, a difference amplifier having a defined offset voltage and provided with a first and a second input, the first input being coupled to the first connection terminal, a first resistor which is connected between the first connection terminal and the second input of the difference amplifier, a first transistor whose base is coupled to an output of the difference amplifier and the main current path of which is connected between the second input of the difference amplifier and an output terminal, it being possible to connect a load between the output terminal and the second connection terminal.

Such a current stabilizing circuit wherein the offset voltage of the difference amplifier is derived from a reference voltage source provided between the first input and the first connection terminal is known from the article "Dynamic load requires no additional power supplies" by R. Bober, published in the United States periodical "Electrical Design News", Vol. 20, March 20th, 1975, No. 6, pp. 76 and 77. The reference voltage source therein is a series arrangement of several diodes in an auxiliary circuit. This has the drawback that the offset voltage, derived from a reference voltage supplied by the reference voltage source is not accurately defined because the reference voltage does not change linearly with time and depends on the current in the diodes. In addition, the minimum operating voltage across the circuit and the current in the auxiliary circuit of the circuit are relatively large which limits its field of application and complicates reduction to integrated form.

It is an object of the invention to provide a new current stabilizing circuit which obviates these drawbacks.

The current stabilizing circuit of the present invention, therefore, includes a difference amplifier which comprises a second and a third transistor whose current densities have been adjusted to mutually different values and whose emitters are interconnected to obtain the defined offset voltage.

In a preferred embodiment of the invention the interconnected emitters of the second and the third transistor are connected to the second connection terminal via a first current source circuit, the emitter effective area of the third transistor being larger than the emitter effective area of the second transistor; the collectors of the second and third transistors are connected to the first connecting terminal through a current mirror circuit; and the base of the second transistor is the first input of the difference amplifier; and the base of the third transistor is the second input of the difference amplifier.

This construction has the advantage that a defined offset voltage is realized in a very simple manner.

In a further preferred embodiment of the invention the circuit comprises a fourth transistor with its base connected to the collector of the third transistor, its collector connection to the first connecting terminal and its emitter connected to the base of the first transistor and to the second connecting terminal via a second current source circuit. This embodiment has the advantage that, the high current gain of the cascade circuit (of the fourth and the first transistor) a current flow through the difference amplifier which is very small in relation to the current through the load, and has the additional advantage that the circuit is very stable because the currents in the second and third transistors are small with respect to the current flowing in the first transistor.

The invention will be further explained with reference to an embodiment shown in the drawings, in which.

Figure 1:
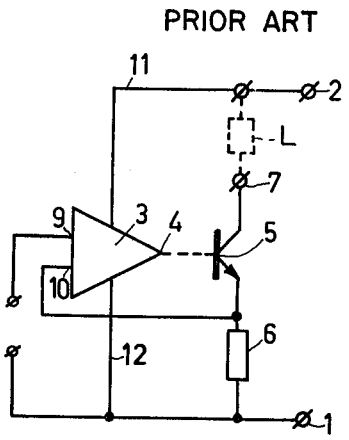
FIG. 1 shows a prior art current stabilizing circuit.

The prior art current stabilizing circuit shown in FIG. 1 comprises a first and a second connecting terminal 1 and 2 and a difference amplifier 3 having a defined offset voltage.

The first input 9 of the difference amplifier 3 is coupled to the connecting terminal 1 through a reference voltage source (not shown) and the second input 10 to the emitter of a transistor 5. The output voltage of this difference amplifier is supplied via an output 4 to the base of the transistor 5 whose emitter is connected to the first connection terminal 1 through a resistor 6. The offset voltage of the difference amplifier 3 which is produced by the reference voltage source is connected across the resistor 6. In addition, the collector of transistor 5 is connected to an output terminal 7. A load L is connected between the output terminal 7 and the second connecting terminal 2. A supply current is applied from connecting terminal 2 through the difference amplifier 3, to the first connecting terminal.

The magnitude of the current flowing through the load L is determined within the operating range of the difference amplifier by the offset voltage which is connected across the resistor 6 and the value of this resistor and is consequently independent of the voltage connected between the connecting terminals 1 and 2.

Figure 2:
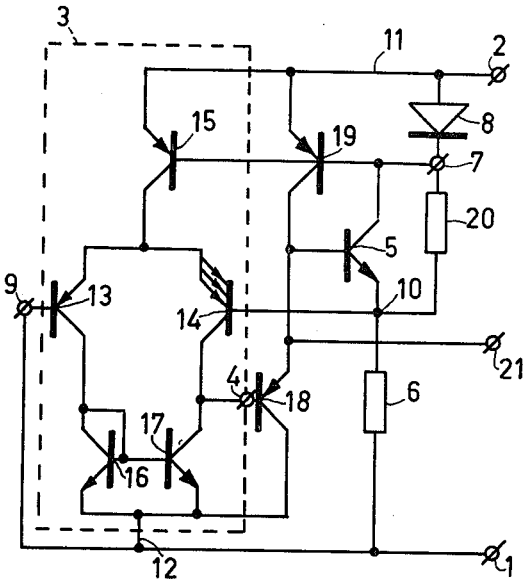
FIG. 2 shows an embodiment of the current stabilizing circuit according to the invention.

The stabilizing circuit according to the invention and the special advantages of this circuit are explained with reference to the embodiment which is shown in detail in FIG. 2, in which components corresponding to FIG. 1 have been given the same reference numerals.

The difference amplifier 3 comprises a second transistor 13 and a third transistor 14 whose emitters are interconnected and connected to the second terminal 2 through a transistor 15 which is connected as a current source. The base of transistor 13 is the first input 9 and the base of transistor 14 is the second input 10 of the difference amplifier 3.

The first input terminal of the difference amplifier 3 is connected to the first connection terminal 1. The current densities of the second transistor 13 and the third transistor 14 are set to mutually different values to obtain a defined offset voltage. These different current densities are realized in this embodiment because the effective area of the emitter of third transistor 14 designed a number of times larger, than the effective area of the emitter of the second transistor 13, and, because a current mirror circuit (consisting of a transistor 16 which is connected as a diode and a fifth transistor 17) is connected between the collectors of the second and third transistors 13 and 14 and the first terminal. The transistors 16 and 17 are chosen so that the collector currents in the transistors 13 and 14 are equal. Equal collector currents and the unequal emitter effective areas cause base-emitter voltages of the transistors 13 and 14 to be related as the logarithm of the ratio of the reciprocal values of their emitter effective areas. For example, the base-emitter voltage of transistor 14 is a factor of 3 smaller than the base-emitter voltage of transistor 13 in this embodiment.

The sum of the voltages around the loop defined by the base-emitter junction of transistor 13, the emitter-base junction of transistor 14, the second input 10 of difference amplifier 3, the resistor 6, and the first input of the difference amplifier 3 is equal to zero. The voltage difference between the base-emitter junctions of transistors 13 and 14 is consequently generated across the resistor 6. The current in transistor 5 is supplied via collector output terminal 7 to the load 8. The load current is consequently equal to the offset voltage divided by the value of resistor 6 and is independent of the operating voltage connected between the terminals 1 and 2.

The circuit's minimum operating voltage is equal to the sum of the base-emitter voltage of the transistor 13 and the emitter-collector voltage of the transistor 15 which is connected as a current source. To prevent the transistors 13 and 14 from being cut-off with zero input voltage on terminal 9 the effective areas of the emitter of the transistors 16, which is connected as a diode, and the transistor 17 must be sufficiently larger than the effective area of the emitter of the third transistor 14.

It should be noted that an offset voltage can also be obtained by making the emitter effective areas of the transistors 13 and 14 equal to one another and by choosing the current mirror circuit so that the ratio of the collector currents has a value which deviates from unity.

The circuit further comprises a fourth transistor 18 whose base is connected to the collector of the third transistor; whose collector is connected to the first connecting terminal and whose emitter is connected to the base of the first transistor 5 and to the second connecting terminal 2 through a transistor 19 which is connected as current source. The transistors 18 and 5 constitute an output amplifier having a high current gain factor, for example 4000. The high current gain of transistor 5 as well as the high current amplification factor of the output amplifier causes the sum of the currents which flow through the current sources 15 and 19 to be small with respect to the effective current supplied at the output terminal 7.

The negative feedback produced by connecting the emitter of transistor 5 to input 10 makes the circuit very stable. This stability is maintained at high frequencies because the effective areas of the emitters of the transistors 16 and 17 are relatively large.

Owing to these large effective areas the output signal of the difference amplifier decreases relatively fast, as a function of frequency. So much, in fact, that the total amplification of the difference amplifier 3 and the output amplifier (transistors 18 and 5), are smaller than unity at parasitic oscillation frequencies where the phase rotation of the output amplifier has changed so much that negative feedback no longer occurs.

Transistor 5 is complementary to transistor 18. In addition, the base-emitter voltage of transistor 18 must be is much smaller than the base-emitter voltage of transistor 5 so that a sufficient operating voltage is obtained for the fifth transistor 17. The shift of the voltage level caused by the base-emitter junction of the transistor 18 is compensated for by the slightly larger but oppositely directed shift of the voltage level caused by the base-emitter junction of transistor 5 so that the low minimum operating voltage of the current stabilizing circuit is maintained.

The low minimum operating voltage, the very low current dissipation of current sources 15 and 19 and high stability make this circuit particularly suitable for use in electronic subscriber's set circuits, for example as a stabilizing circuit for a two-tone dial signal generator constructed in $I^2L$. Such a generator 8 has the current-voltage characteristic of a semiconductor diode 8. The bases of the transistors 15 and 19 are connected to output terminal 7 so that these transistors function, in known manner, as current sources in response to the diode-like behavior of the load 8.

A second resistor 20 is connected in parallel with the main current path of transistor 5, which resistor has a high value relative to the first resistor 6 and thus causes the stabilizing circuit to start when the connection terminals 1 and 2 are connected to a power supply, for example to a subscriber's line.

The emitter of transistor 18 is connected to a control input 21. This control input can be connected in a manner, not shown, to connecting terminal 1. The transistor 5 is then cut-off and no current is supplied through it to the load 8. In that event current from current source 19 flows to connecting terminal 1 and the current which flows through the load 8 is determined by the resistor 20.

It should be noted that the current which is supplied to the load 8 has a defined drift of 0.15% per degree celsius, which drift can be compensated in the load.

Figure 3:
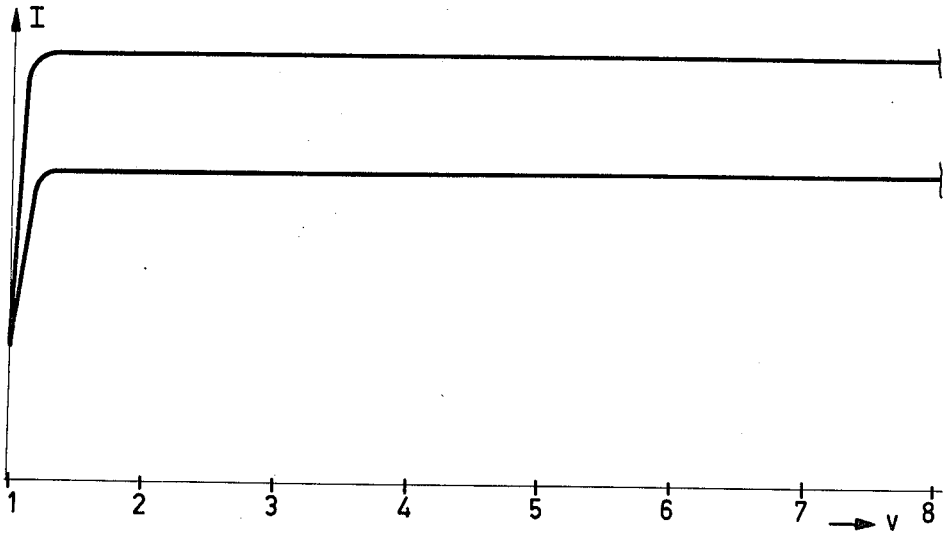
FIG. 3 is a graph in which the output current is plotted as a function of the operating voltage across the stabilizing circuit of the embodiment shown in FIG. 2.

FIG. 3 shows, for two different values of the first resistor 6, the supplied load current as a function of the operating voltage applied across the circuit. As is apparent from this figure the minimum operating voltage is approximately 1.2 volts, the maximum operating voltage at least 8 volts and the load current between this minimum and maximum operating voltage changes by only 4%.

What is claimed is:

1. A current stabilizing circuit comprising in combination:

a first terminal and a second terminal, a difference amplifier including a first input connected to the first terminal, a second input, and means which define an offset voltage;

a first resistor connected between the first terminal and the second input of the difference amplifier; and a first transistor having a drive electrode connected to an output of the difference amplifier and a main current path connected between the second input of the difference amplifier, and an output terminal;

wherein said means which define an offset voltage include a second transistor and a third transistor in which current densities are adjusted to mutually different values and having emitters which are interconnected.

2. A circuit as claimed in claim 1 further comprising:

a current source connected between said interconnected emitters and said second terminal;

a current mirror connecting the collectors of said second and third transistors to said first terminal.

3. A circuit as claimed in claim 2, wherein the effective emitter area of the third transistor is larger than the effective emitter area of the second transistor and the current mirror circuit produces equal collector currents in the second transistor and the third transistor.

4. A circuit as claimed in claim 2, wherein the effective emitter areas of the second transistor and the third transistor are equally large and the current mirror circuit produces a larger collector current in the second transistor than it does in the third transistor.

5. A circuit as claimed in claim 2, further comprising:

a fourth transistor having a control electrode connected to the collector of the third transistor, a collector, connected to the first terminal and an emitter connected to the control electrode of the first transistor and a second current source circuit connecting the second terminal to the control electrode of the first transistor.

6. A circuit as claimed in claim 5, wherein the first transistor is complementary to the fourth transistor.

7. A circuit as claimed in claim 5, wherein the current source circuits each comprise a further transistor, the control electrodes of which are connected to the output terminal and further comprising a load having a diode characteristic connected between the second terminal and the output terminal.

8. A circuit as claimed in claim 5, wherein the emitter of the fourth transistor is connected to a control input for switching the current stabilizing circuit on or off under the control of a signal.

9. A circuit as claimed in claim 2, wherein a second resistor, whose value is high relative to the first resistor, is connected in parallel with the main current path of the first transistor.

10. A circuit as claimed in claim 2, wherein the current mirror circuit comprises diode means connected to the collector circuit of the second transistor and a main current path of a fifth transistor connected in the collector circuit of the third transistor, the base-emitter junction of the fifth transistor being connected across the diode means and its drive electrode being connected to the collector of the second transistor, the effective area of a semiconductor junction of the diode means and the effective area of the emitter of the fifth transistor being sufficiently larger than the effective area of the emitter of the third transistor to produce an operating voltage which is sufficient for the second transistor.

* * * * *